United States Patent [19]

Stanfill et al.

[11] Patent Number: 4,856,678

[45] Date of Patent: Aug. 15, 1989

[54] BEVERAGE DISPENSER WITH ICE WATER PRECOOLER

[75] Inventors: Ted M. Stanfill, Fort Worth, Tex.; Joe K. Dugger, 3512 Elm Creek Ct., Fort Worth, Tex. 76109

[73] Assignee: Joe K. Dugger, Fort Worth, Tex.

[21] Appl. No.: 162,032

[22] Filed: Feb. 29, 1988

[51] Int. Cl.[4] ..... B67D 5/62

[52] U.S. Cl. ..... 222/108; 222/146.6; 62/396

[58] Field of Search ..... 222/108, 129.1, 130, 222/131, 146.1, 146.6, 318; 62/348, 389, 396, 398–400

[56] References Cited

U.S. PATENT DOCUMENTS

| | | | |
|---|---|---|---|
| 1,382,274 | 6/1921 | De Beers | 62/399 X |
| 2,085,186 | 11/1935 | Eger | 62/376 |
| 2,871,675 | 2/1959 | Cornelius | 222/146.6 X |
| 3,180,108 | 8/1963 | Rhodes | 62/222 |
| 3,209,952 | 11/1962 | Cornelius | 222/129.1 |
| 3,224,641 | 12/1965 | Morgan | 222/131 X |
| 3,280,592 | 10/1966 | Barday | 62/399 |
| 3,605,430 | 5/1969 | Conti | 62/137 |
| 4,094,445 | 6/1978 | Bevan | 222/1 |
| 4,171,069 | 10/1979 | Cornelius et al. | 222/1 |
| 4,555,045 | 11/1985 | Rodth et al. | 222/1 |
| 4,641,763 | 2/1987 | Landers et al. | 222/129.1 |
| 4,676,400 | 6/1987 | Lamont et al. | 222/1 |

*Primary Examiner*—Michael S. Huppert

*Attorney, Agent, or Firm*—James E. Bradley

[57] ABSTRACT

A beverage dispenser is disclosed which utilizes an ice water precooler. The beverage dispenser utilizes a rectangular ice bin having an aluminum cold plate in the bottom. The cold plate includes at least one vertical aperture to permit waste liquid from melting ice to run into a waste liquid tank below the ice bin. A helical concentric tube having an inner conduit substantially concentric with an outer conduit is placed in the waste liquid tank and preferably submerged in ice water. A source of beverage is coupled to the inner most conduit of the concentric tube and thereafter to a serpentine passage through the cold plate. A pump is utilized to force ice water from the waste liquid tank through a second serpentine passage in the cold plate, through the outer conduit of the concentric tube and back to the waste liquid tank. An overflow drain is utilized to limit the level of fluid within the waste liquid tank.

10 Claims, 1 Drawing Sheet

Fig. 1
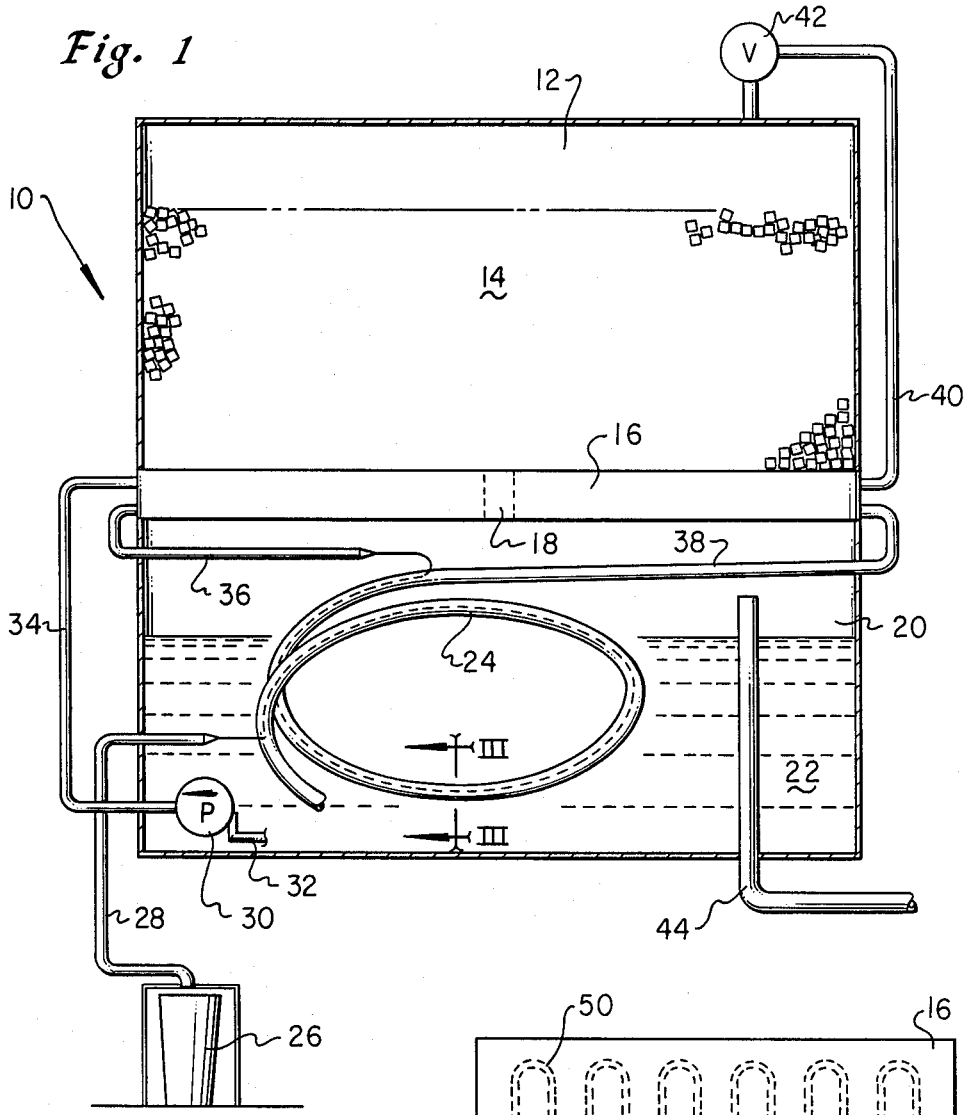
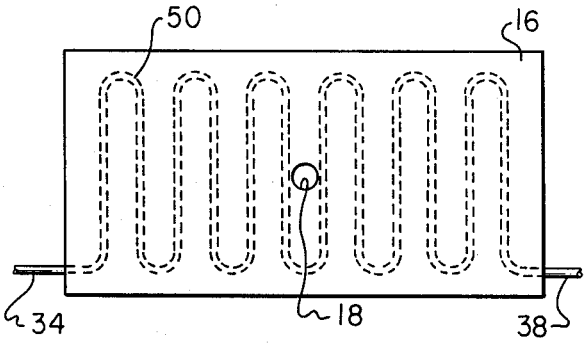
Fig. 2
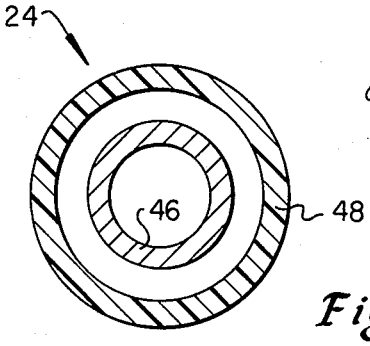
Fig. 3

BEVERAGE DISPENSER WITH ICE WATER PRECOOLER

CROSS REFERENCE TO RELATED APPLICATION

This United States patent application Ser. No. 07/162,093, filed Feb. 29, 1988 is being filed simultaneously with an Application entitled "ICE MAKING APPARATUS", inventor Ted M. Stanfill, which contains some common subject matter.

BACKGROUND OF THE INVENTION

1. Field of the Invention:

This invention relates in general to beverage dispensers and in particular to beverage dispensers which utilize ice to cool the beverage.

2. Description of the Prior Art:

Cold beverage dispensers are well known in the prior art. Such dispensers typically utilize either refrigeration systems or bulk refrigerants such as ice to cool the beverage prior to dispensing. While refrigeration systems are well known and highly efficient, their size, bulk and weight make them unsuitable for small portable dispensers or dispensers which are utilized at temporary locations such as at a sports stadium, or other outdoor activities.

Cold beverage dispensers for utilization at such outdoor sites are typically systems which utilize ice to cool the beverage. Generally a large ice bin is provided with a so-called "cold plate" in the bottom. The cold plate is generally an aluminum plate which includes a serpentine fluid passage through which the beverage must pass prior to dispensing. The presence of ice atop the cold plate is utilized to cool the beverage. Such systems are useful; however, they have several shortfalls.

For example, it is not generally possible for cubes or chunks of ice to fully mate with the surface of the cold plate. The resultant air pockets slow the transfer of heat from the beverage into the ice. Additionally, the large metal mass of the cold plate is slow to cool and it may take some time to achieve operating temperatures. In order to solve these problems, certain known systems have attempted to precool the beverage by passing a coil containing the beverage through a cooling medium prior to its entering the cold plate. While these systems enhance the operation of a cold beverage dispenser, they do not solve the heat transfer problem enumerated above nor do they provide a method of rapidly cooling the cold plate to operating temperatures.

Therefore, it should be obvious that a need exists for an improved cold beverage dispenser that will solve these problems.

SUMMARY OF THE INVENTION

It is therefore one object of the present invention to provide an improved cold beverage dispenser.

It is another object of the present invention to provide an improved cold beverage dispenser which utilizes ice as a cooling medium.

It is yet another object of the present invention to provide an improved cold beverage dispenser which precools the beverage prior to its entering the cold plate.

It is still another object of the present invention to provide an improved cold beverage dispenser which includes means for additional cooling of the cold plate.

The foregoing objects are achieved as is now described. The beverage dispenser of the present invention utilizes an ice water precooler to aid in cooling the beverage. A rectangular ice bin is provided which includes a cold plate in the bottom thereof. Apertures in the cold plate permit waste liquid from the melting ice to flow into a waste liquid tank below the ice bin. A helical concentric tube, having an inner and outer conduit, is positioned within the waste liquid tank and submerged in ice water. A beverage source is then coupled to the inner conduit and is further coupled to a serpentine fluid path in the cold plate to a dispensing valve. A pump is utilized to pump ice water from the waste tank through a second fluid path in the cold plate and through the outer conduit. In this manner, both the beverage and cold plate are precooled by ice water which would otherwise be drained and wasted.

The above as well as additional objects, features, and advantages of the invention will become apparent in the following detailed description.

BRIEF DESCRIPTION OF THE DRAWING

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

FIG. 1 is a partially sectional and partially schematic view of the beverage dispenser of the present invention;

FIG. 2 is a top view of the cold plate of the beverage dispenser in FIG. 1; and FIG. 3 is a cross section of a concentric beverage tube of the beverage dispenser of the present invention taken along line III—III of FIG. 1.

DETAILED DESCRIPTION OF THE INVENTION

With reference now to the figures and in particular with reference to FIG. 1, there is depicted a partially sectional and partially schematic view of beverage dispenser 10 of the present invention. As can be seen, beverage dispenser 10 includes an ice bin 12 which is preferably constructed of stainless steel, aluminum or other metallic material. Ice bin 12 is utilized to contain a large quantity of ice 14 which rests on cold plate 16 in the bottom of ice bin 12. Cold plate 16 preferably includes a plurality of fluid passages which are utilized in a manner which will be explained in greater detail herein.

Cold plate 16 also includes an aperture 18 Which is utilized to permit waste liquid 22 from melting ice 14 to collect in waste liquid bin 20 which is provided below ice bin 12. In a preferred embodiment of the present invention the upper surface of cold plate 16 is preferably shaped to enhance the flow of waste liquid into aperture 18.

Disposed within waste liquid bin 20 and preferably submerged beneath waste liquid 22 is helical concentric tube 24 which is utilized to convey beverage and waste liquid in a manner described herein. As depicted in FIG. 3, helical concentric tube 24 preferably includes an inner conduit 46 which is substantially concentric with an outer conduit 48.

Helical concentric tube 24 is utilized in conjunction with the novel beverage dispenser of the present invention to precool the beverage contained within pressurized beverage container 26. The beverage contained therein is coupled, via conduit 28, to inner conduit 46 of helical concentric tube 24. After passing through inner conduit 46, the beverage is then coupled, via conduit 36, to a serpentine fluid passage disposed within cold plate 16 to be cooled by contact of ice 14 with cold plate 16 in a manner similar to techniques known in the prior art. Thereafter, the beverage is coupled from the serpentine fluid passage disposed within cold plate 16 via conduit 40 to beverage dispenser valve 42.

Still referring to FIG. 1, it can be seen that the cooling of the beverage contained within pressurized beverage container 26 is further enhanced in the following manner. Pump 30 is utilized to draw waste liquid 22, via conduits 32 and 34, to a second serpentine fluid passage disposed within cold plate 16. Pump 30 is preferably a small electrical centrifugal pump of a type and nature well known in the prior art. In this manner, the icy nature of waste liquid 22 may be utilized to aid in the cooling of cold plate 16, allowing fairly rapid cooling of the large mass of cold plate 16, which is preferably constructed of aluminum or other metallic material. After passing through cold plate 16, waste liquid 22 is coupled, via conduit 38 to outer conduit 48 of helical concentric tube 24. Thus, the reservoir of icy waste liquid within waste liquid bin 20 is utilized to precool both the beverage and cold plate 16. As can be seen, drain pipe 44 is provided and is utilized to prevent the level of waste liquid 22 from exceeding a desired level within waste bin 20.

With reference now to FIG. 2, there is depicted a top view of cold plate 16 which includes a shadow depiction of a single serpentine fluid passage 50 By utilizing such serpentine fluid passages it is possible to cool a beverage passing through cold plate 16 and further to precool cold plate 16 by passing waste liquid 22 through a similar fluid passage within cold plate 16.

Thus, it should be apparent to those skilled in the art, that by utilizing the novel beverage dispenser of the present invention it is possible to provide a beverage dispenser which utilizes ice water which would otherwise be wasted to enhance the efficiency of the dispenser by precooling both the beverage and the cold plate with the ice water.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. Beverage dispensing means comprising:

an ice storage bin for receiving ice, said ice storage bin having a cold plate disposed at the bottom thereof having at least one aperture there through wherein waste liquid from melting ice will pass through said cold plate;

a plurality of fluid passages disposed within said cold plate;

a waste liquid bin disposed at least partially below said ice storage bin for receiving waste liquid from melting ice within said ice storage bin;

a length of concentric tubing disposed at least partially within said waste liquid bin, said length of concentric tubing having an inner conduit substantially concentrically disposed within an outer conduit;

means for coupling a source of beverage to one end of one of said concentric conduits and means connecting the other end of said concentric conduit to a first end of a first fluid passage disposed within said cold plate; and means for coupling said waste liquid to one end of a second of said concentric conduits and means connecting the other end of said second concentric conduit to a first end of a second fluid passage disposed within said cold plate.

2. Beverage dispensing means according to claim 1 wherein said waste liquid bin is disposed entirely below said ice storage bin.

3. Beverage dispensing means according to claim 1 further including pump means for pumping waste liquid through said second concentric conduit.

4. Beverage dispensing means according to claim 1 further including a beverage dispenser valve coupled to a second end of said first fluid passage disposed within said cold plate.

5. Beverage dispensing means according to claim 1 wherein at least one o said plurality of fluid passages disposed within said cold plate comprises a serpentine passage.

6. Beverage dispensing means according to claim 1 wherein said cold plate is constructed of aluminum.

7. Beverage dispensing means according to claim 1 wherein at least a portion of said length of concentric tubing disposed at least partially within said waste liquid bin is helical in shape.

8. Beverage dispensing means according to claim 1 further including means coupling a second end of said second fluid passage disposed within said cold plate to said waste liquid bin wherein said waste liquid is recirculated.

9. Beverage dispensing means according to claim 1 wherein said waste liquid bin also includes overflow means for limiting the level of waste liquid within said waste liquid bin.

10. Beverage dispensing means according to claim 1 wherein said means for coupling a source of beverage to one end of one of said concentric conduits and said means connecting the other end of said concentric conduit to a first end of said first fluid passage disposed within said cold plate couples said source of beverage to said inner conduit.

* * * * *